US005090164A

United States Patent [19]

Mische

[11] Patent Number: 5,090,164

[45] Date of Patent: Feb. 25, 1992

[54] CONSTRUCTION SET FOR A CONSTRUCTION PROJECT

[76] Inventor: Gerhard Mische, Hamelner Strasse 134 A, D-4920 Lemgo, Fed. Rep. of Germany

[21] Appl. No.: 598,597

[22] PCT Filed: Feb. 29, 1990

[86] PCT No.: PCT/EP90/00326

§ 371 Date: Oct. 18, 1990

§ 102(e) Date: Oct. 18, 1990

[87] PCT Pub. No.: WO90/10124

PCT Pub. Date: Sep. 7, 1990

[30] Foreign Application Priority Data

Mar. 2, 1989 [JP] Japan ..... 3906566

[51] Int. Cl.[5] ..... E04B 7/02; E06B 1/04

[52] U.S. Cl. ..... 52/90; 52/731; 52/403; 49/DIG. 1

[58] Field of Search ..... 52/97, 209, 235, 90, 52/397–403, 731, 732, 204, 208; 49/DIG. 1

[56] References Cited

U.S. PATENT DOCUMENTS 4,598,513 7/1986 Gartner ..... 52/235

FOREIGN PATENT DOCUMENTS 0076703 4/1983 European Pat. Off. .
2329573 5/1974 Fed. Rep. of Germany ..... 52/732
2927463 1/1981 Fed. Rep. of Germany .
3526714 2/1987 Fed. Rep. of Germany ..... 52/400
3514540 9/1988 Fed. Rep. of Germany .
1106734 7/1955 France ..... 52/732

*Primary Examiner*—James L. Ridgill, Jr.
*Attorney, Agent, or Firm*—Browdy and Neimark

[57] ABSTRACT

The construction set for a construction project, in particular winter gardens, canopies or awnings for entryways or windows, has a basic profile (1) usable as a support, purlin, crossbeam, lateral roof profile and wall attachment profile, having two intrinsically thermally separate cross-sectional segments (18, 19) and fastening grooves 4, 5 or undercut cross section located on the inside and receiving chambers (2, 3) located on the inside. Support, stop and sealing profiles (6, 7, 27, 8) and connectors are detachably insertable into the fastening grooves (4, 5), the receiving chambers (2, 3), and outsides of basic profiles, which with the basic profile (1) form a framework for a fixed support and abutment of roof and wall elements, preferably panes of glass or plastic panels.

11 Claims, 6 Drawing Sheets 27
33
34

31
30
32
7

19
3
5
5
20
17
17
20
4
4
29
28
6b
6a
6c
6

2
1
18

8b
24
23

8
21
8a
25
26
22

"B"

"A"

I-I

II-II

CONSTRUCTION SET FOR A CONSTRUCTION PROJECT

The invention seeks to create a construction set for variably formed construction projects, in particular winter gardens, canopies or porch roofs or window awnings, which has a versatile main profile and simple, easily mounted connecting and covering means, which result in a stable, thermally insulated connection and a clean, tight seal.

According to the invention, this object is attained by the characteristics of the body of claim 1, and embodiment characteristics recited in the dependent claims define advantageous further features of the invention.

The subject of the invention extends not only to the characteristics of the individual claims, but also to their combination.

The construction set according to the invention is an aluminum system for the variable design of construction projects of the most various kind, and by means of this aluminum system an intrinsically stable framework that avoids heat conducting points and is simple to assemble is created, in which ceiling and wall elements, such as glass panes, plastic panels, double-rib panels, sliding elements and the like are securely held and perfectly sealed without using silicon as a sealing means.

Because of the main profiles and the connecting and covering means, this aluminum system also exhibits extremely favorable shedding of rainwater and water from melting snow and ice.

The construction set has an intrinsically thermally insulated basic profile, which can be used for pillars, purlins, lateral roof profiles, attachment profiles, and purlin crossbeam profiles, so that this basic profile has versatile utility, and practically only one profile type is needed for the construction project.

For mounting and supporting the wall and ceiling elements, support and stop profiles are provided that need merely be suspended in grooves of the basic profiles and provide stable load bearing as well as joining without screws.

Long tubular posts are inserted as attachment profiles into the upright basic profiles (pillars) and produce a good connection with the roof region; this connection is also secured by adjustable connecting angles. The connection of the cross beams to the pillars and to the purlins to the crossbeams or to the attachment profiles is effected by insertable and suspendable connectors and additional T connectors that produce a precise position on the part of the profiles to be connected.

A gutter of large volume, with a large overflow for water, ice and snow can be attached to the framework, and a column-like water pillar located on the outside receives a large downspout in insulated fashion within itself and is formed of profiles that can be opened up.

The basic profile and the connecting and covering means can be made simply and at favorable cost and for the most part can be formed of extruded profiles, so that in the variable design of the construction projects, waste is avoided as much as possible.

In the drawings, an exemplary embodiment of the invention is shown, which is described in further detail below.

Figures 3, 4, 5, 5A, 6, 7:
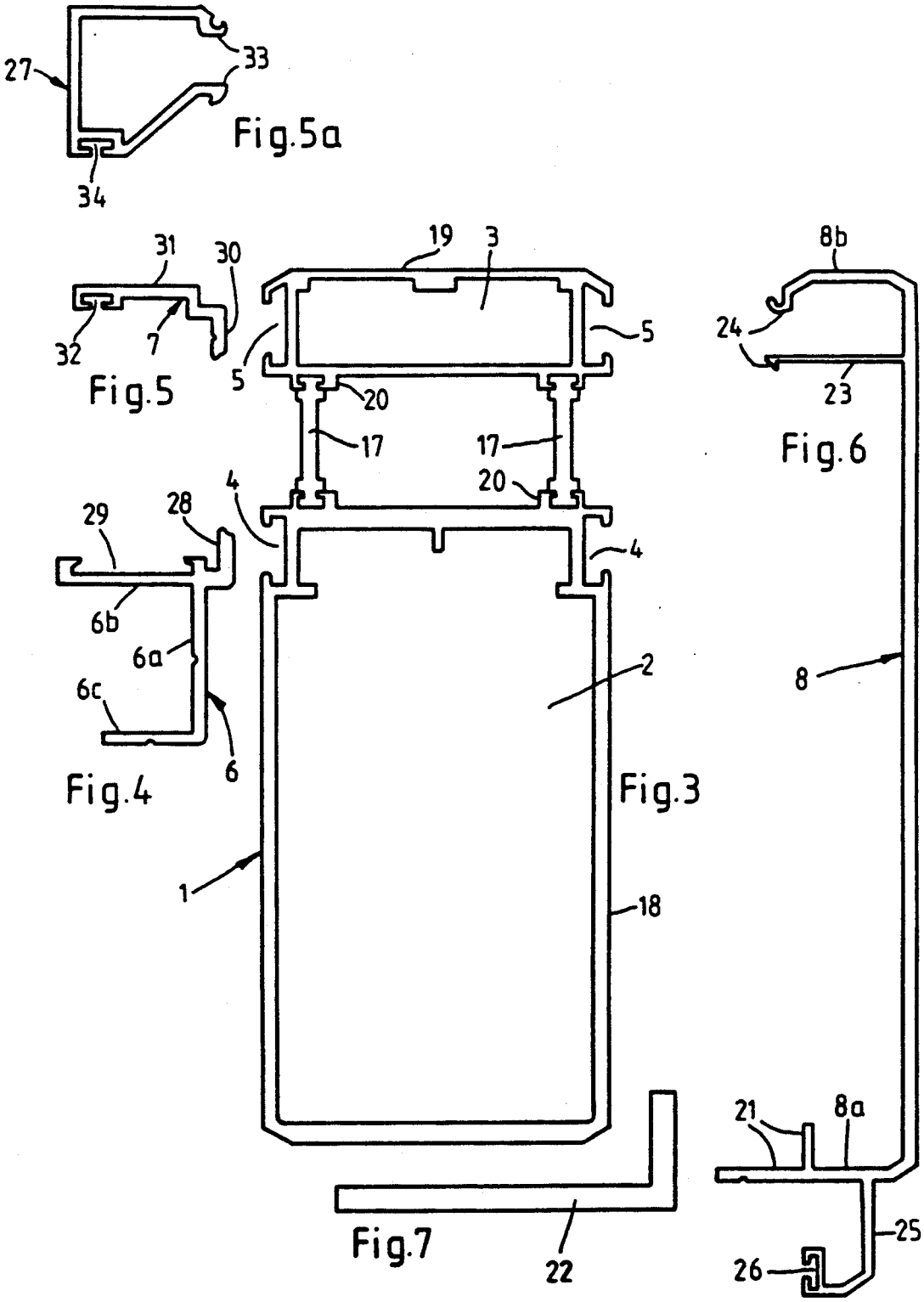
FIG. 3 is a cross section through a basic profile.
FIG. 4 is a cross section through a support profile.

FIGS. 5 and 5*a* are cross sections through two versions of stop profiles.

Figure 1:
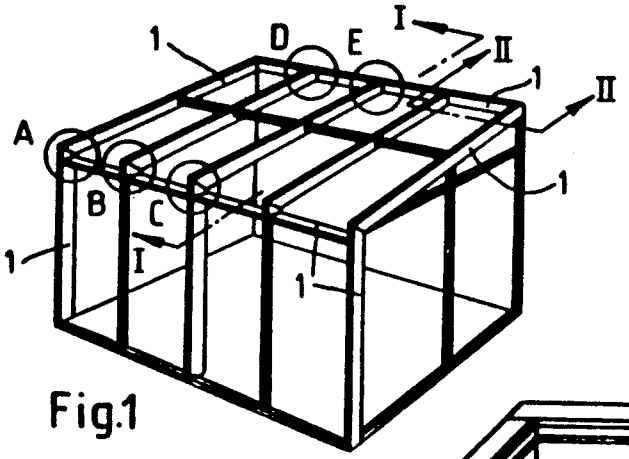
FIG. 1 is a schematic, perspective view of a construction project framework made up of profiles.
Figure 2:
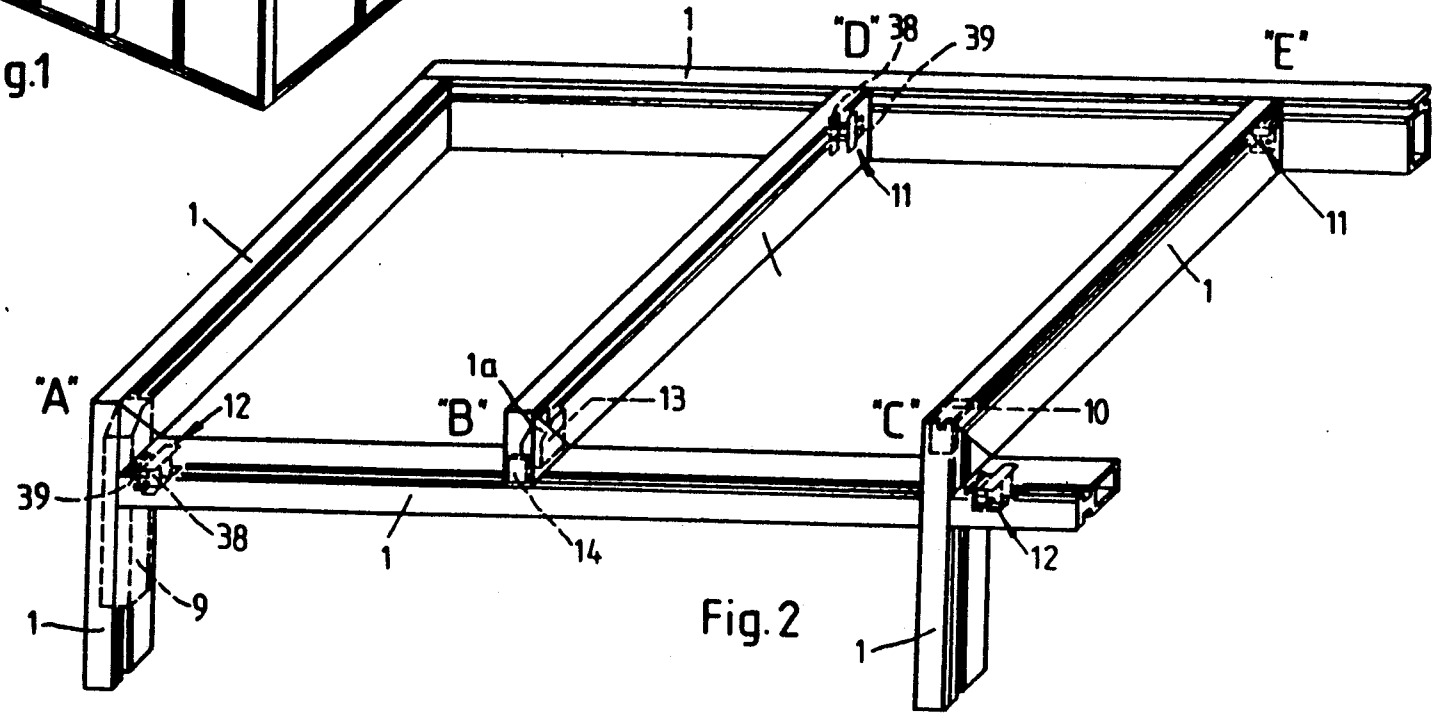
FIG. 2 is a perspective view of the framework in the roof region, with the connecting intersection points A–E of profiles as in FIG. 1.
Figure 9:
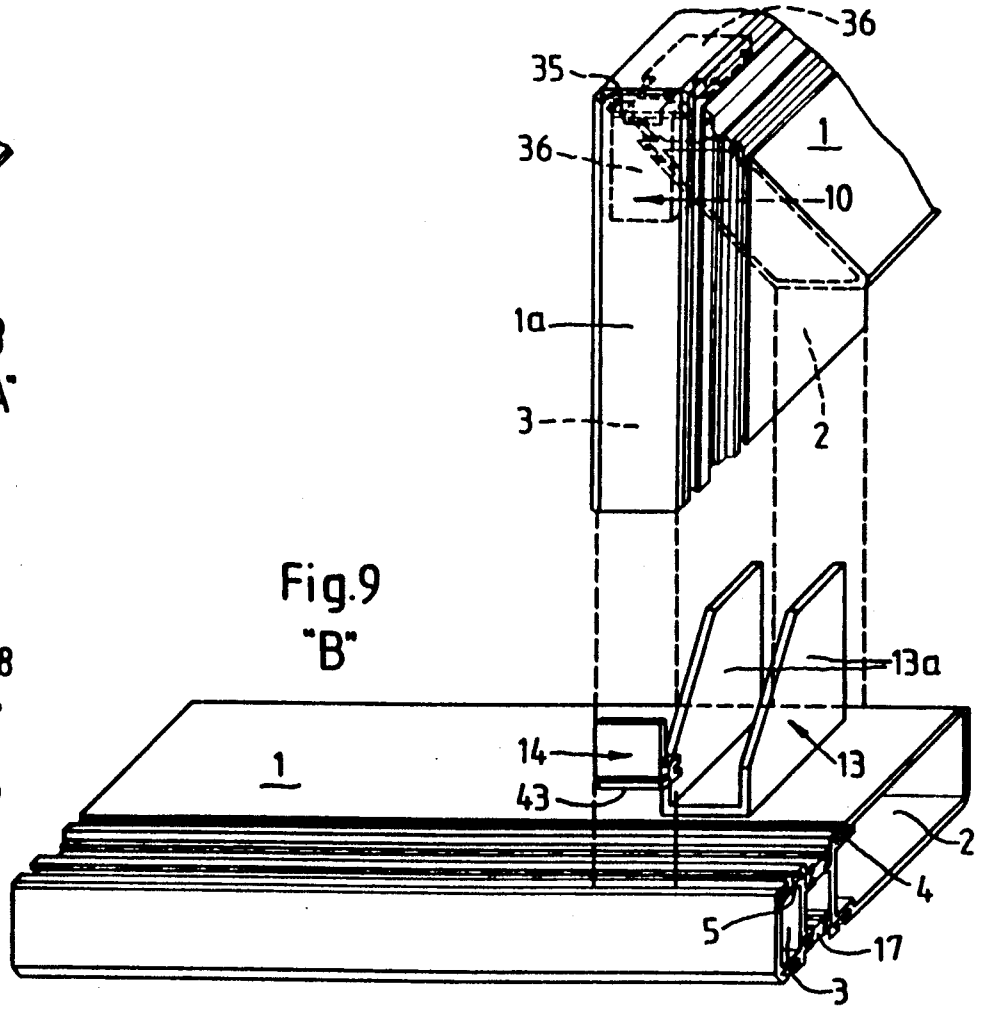
Figure 8:
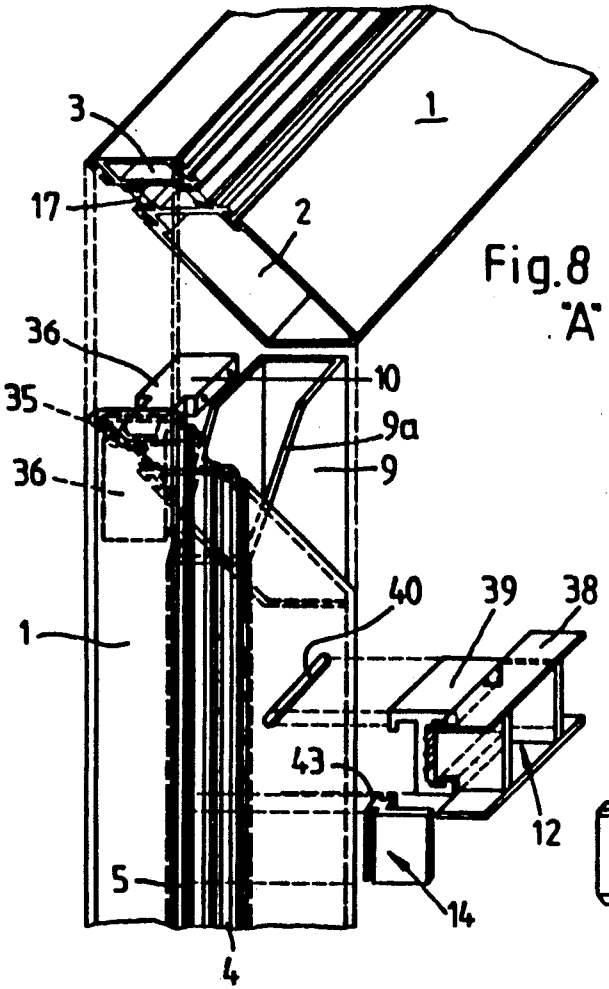
Figure 11:
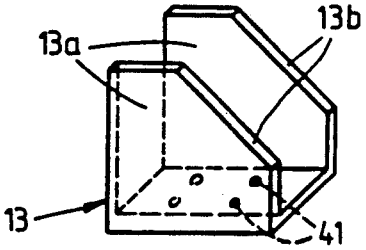
Figure 10:
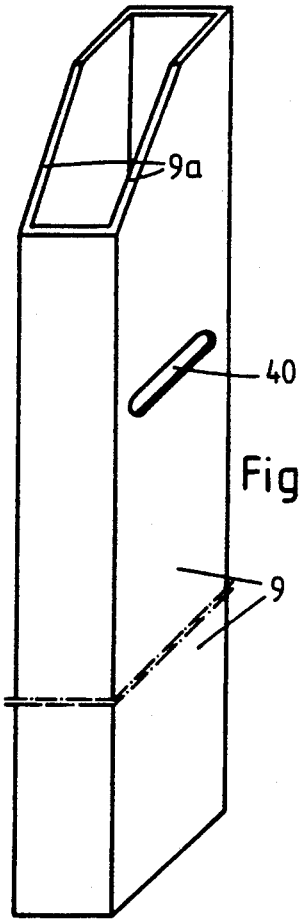
Figure 14:
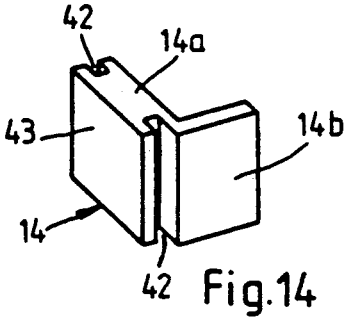
Figure 12:
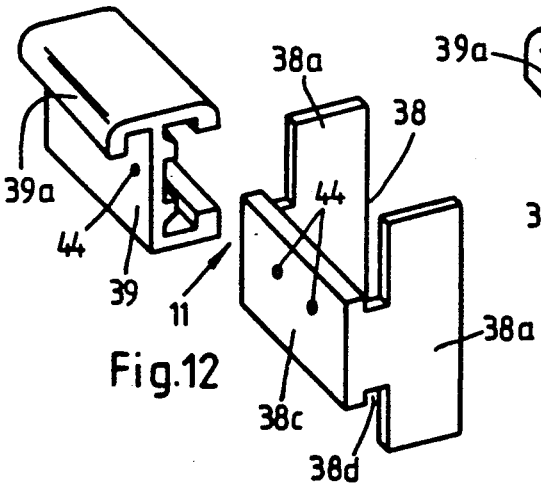
Figure 13:
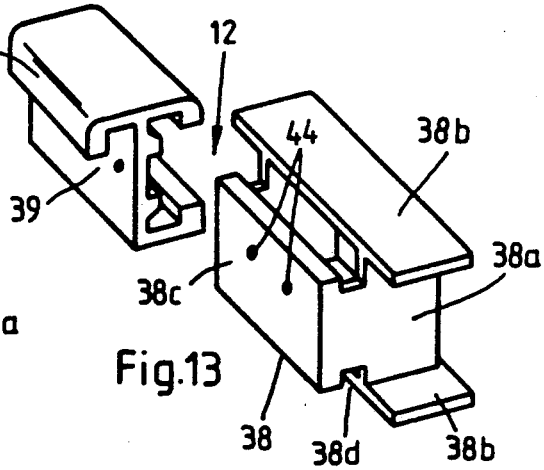
Figures 15, 16, 17:
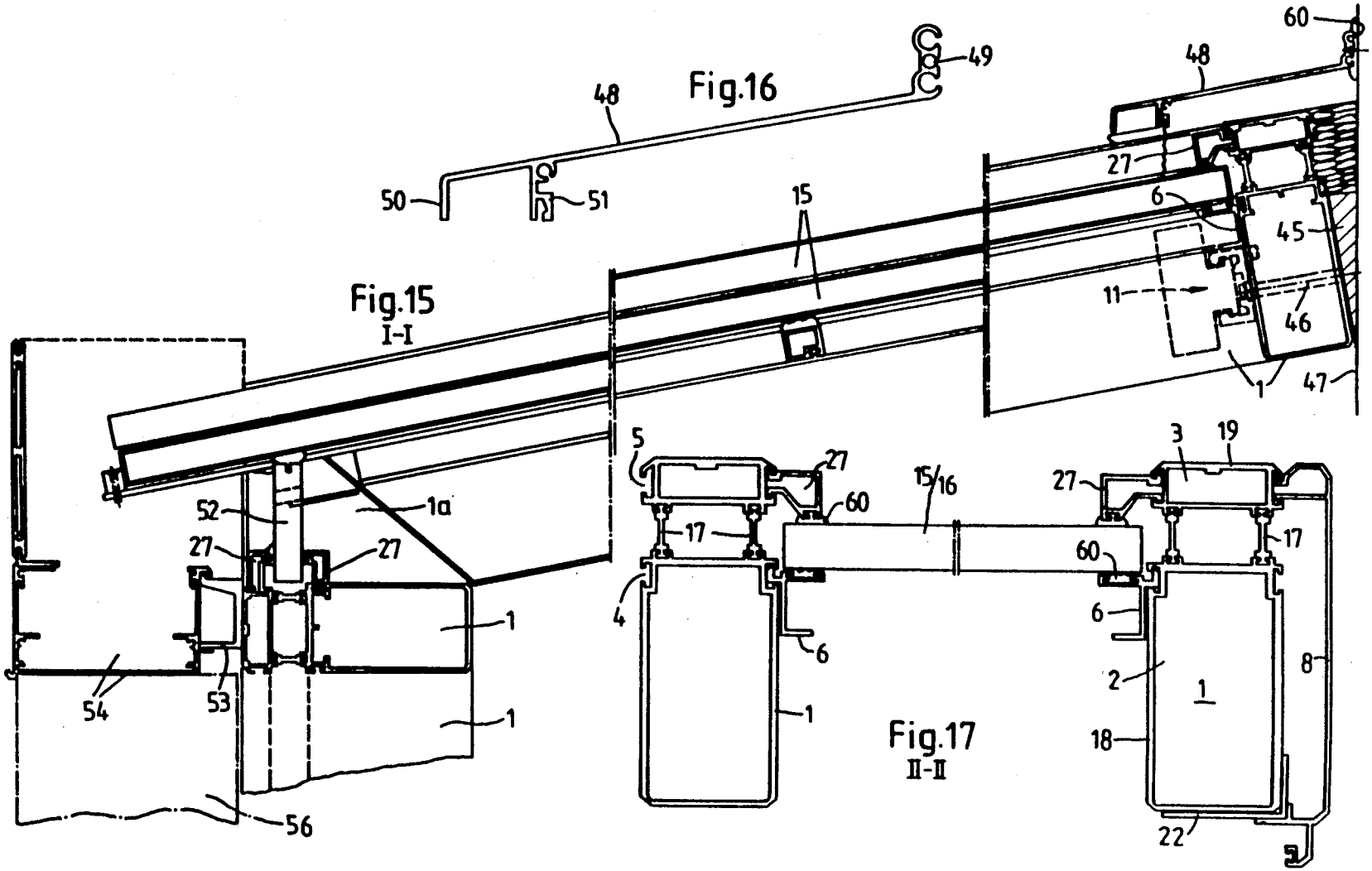
Figure 19:
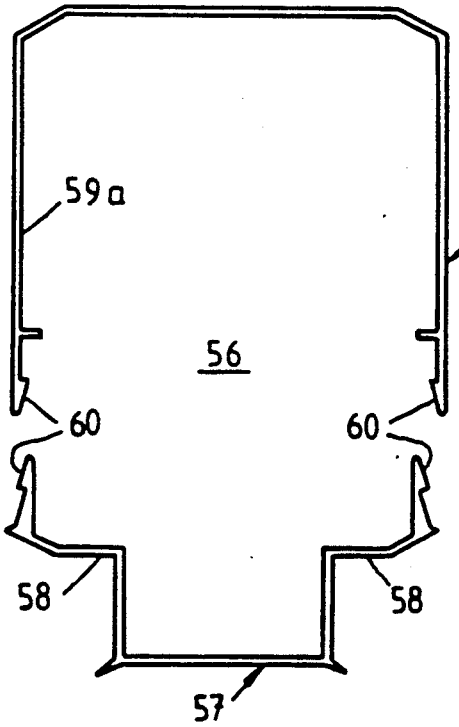
Figure 18:
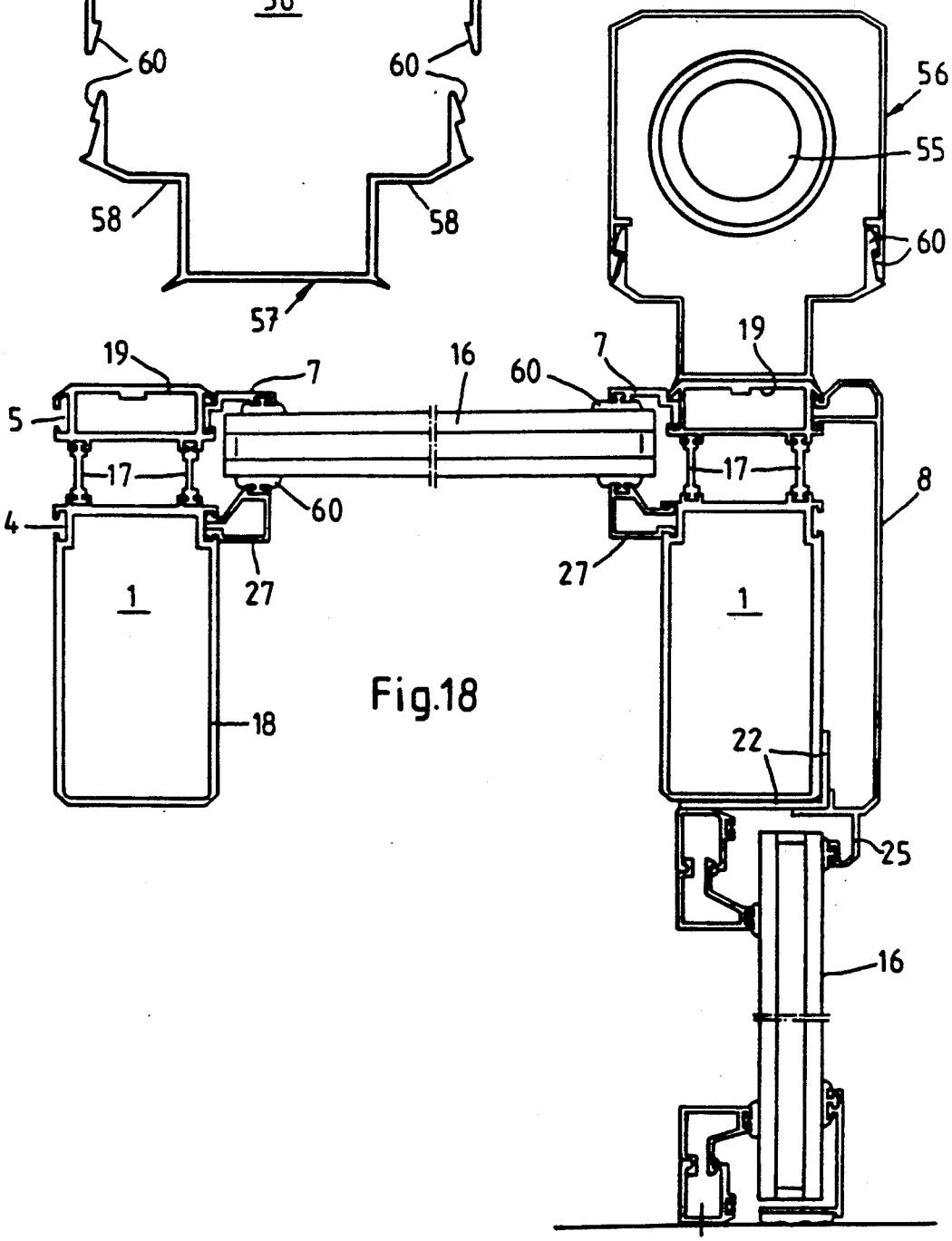

FIG. 6 is a cross section through a covering profile;

FIG. 7 is a cross section through an insulating angle;

FIG. 8 is a perspective view of the connecting point between the vertical basic profile, forming a pillar, and the inclined basic profile representing a purlin, by means of connecting angles, and having a horizontal basic profile representing a by means of a crossbeam connecting profile and t of point A in FIGS. 1 and 2;

FIG. 9 is a perspective view of the connection between a basic profile representing a crossbeam and a purlin, by means of a purlin shoe connector;

FIG. 10 is a perspective view of the tubular pillar;

FIG. 11 is a perspective view of the purlin shoe;

FIG. 12 is a perspective view of the purlin connecting profile, formed by an inset and a holder in the disassembled state;

FIG. 13 is a perspective view of the crossbeam connecting profile, formed by an inset and a holder in the disassembled state;

FIG. 14 perspective view of the T connector;

FIG. 15 is a cross section along the line I—I of FIG. 1 through the roof of the framework with the gutter and flashing;

FIG. 16 is a cross section through a wall sealing profile;

FIG. 17 is a section through the roof region along the line II—II of FIG. 1;

FIG. 18 is a sectional plan view through a corner region of the framework with a disassembleable water compartment disposed on the basic profile; and FIG. 19 is a cross section through the water compartment formed of two profiles that can be joined together.

The construction set for a construction project, in particular a winter garden, canopy, or awning over an entryway or window, has a basic profile 1 that can be used as a support (pillar), purlin, crossbeam, lateral roof profile and wall attachment profile, having two intrinsically thermally separate cross-sectional segments, which form internal receiving chambers 2, 3 and have fastening grooves 4, 5 with an undercut cross section on the outside.

Support profiles 6, stop profiles 7, 27 and covering profiles 8 are detachably inserted into the fastening grooves 4, 5, and connectors, specifically tubular pillars 9, connecting angles 10, purlin connectors 11, crossbeam connectors 12, purlin shoes 13 and T connectors 14, are detachably inserted into the receiving chambers 2, 3 and on or in the outsides of the basic profile; the profiles 6 to 8 and connectors 9 to 14, together with the basic profiles 1, form a framework for fixed support and abutment of roof and wall elements 15, 16, preferably panes of glass or the like.

The basic profile 1 has a rectangular cross section and is formed of two profile tubes 18, 19 of closed cross section and having a variably sized cross section, which are firmly joined to make a unit by means of two insulating ribs 17 extending in the longitudinal cross-sectional direction. These to profile tubes 18, 19, with their interiors, each form one receiving chamber 2, 3.

The two profile tubes 18, 19 each have a rectangular cross section; the profile tube 19 having the smaller cross section rests with its cross sectional length transversely to the cross sectional length of the profile tube 18 having the larger cross section.

The two insulating ribs 17 nondetachably engage a groove 20 of undercut cross section formed onto one long side of the smaller profile tube 19 and one face end of the larger profile tube 18.

On both sides of the insulating ribs 17, on both long sides of the basic profile of both profile tubes 18, 19, a respective groove 4, 5 of undercut cross section, preferably in the form of a T, is formed on; these grooves 4, 5 are flush with the long sides of the basic profile.

Accordingly, the two grooves 5 are formed on the shorter rectangular sides of the profile tube 19, and the two grooves 4 are formed on the two longer rectangular sides of the larger profile tube 18; the grooves 4 are located in the cross-sectional end region of the profile tube 18 adjacent to the insulating ribs 17, and the two grooves 5 occupy the entire shorter rectangular side of the smaller profile tube 19.

The covering profile 8 is embodied in continuous form and has a U-shaped cross section.

One leg 8*a* of the angle of the covering profile 8 and a rib formed on the inside form an abutment angle 21, with which the covering profile 8, with an interposed insulating angle 22, fits over a corner region of the larger profile tube 18. The other leg 8*b* of the angle and a rib 23 formed onto the rib of the covering profile 8 spaced apart from it and parallel to the angle leg 8*b*are equipped with detent strips 24, which latch into a groove 5 of the smaller profile tube 19.

A thermally separate attachment of the covering profile 8 to the basic profile 1 is brought about by the insulating ribs 17 in the basic profile 1 and the interposed insulating angles 22.

A sealing angle 25 with a securing groove 26 for a seal is formed onto the outside of the angle leg 8*a* of the covering profile 8, and this sealing angle 25 rests sealingly against the roof or wall element 15, 16.

The covering profile 8, with its cavity, also forms a heat insulation chamber on one long side of the basic profile 1.

The support profile 6 shown in FIG. 4 is embodied in continuous form and has a U-shaped cross section, which with the leg 6*a* of its U rests on the outside of the profile tube 18 and engages the groove 4 of the profile tube 18 with a suspension strip 28 that is formed onto this leg 6*a* of the U, the strip 28 being of angular cross section and protruding past the leg 8*b* of the U. The leg 6B of the U is equipped with an undercut groove 29 for receiving a seal, and both legs 6*b*, 6*c* of the U of the support profile 6 provide support and abutment faces for ceiling and wall element 15, 16.

FIG. 5 shows a continuous stop profile 7 of angular cross section, one leg of the angle of which is embodied as a suspension strip 30 of angular cross section that can be inserted into the groove 5 of the profile tube 19, and the other leg of the angle of which forms a stop strip 31, opposite the support profile 6, with a formed-on receiving groove 32 for a seal.

FIG. 5*a* shows a stop profile 27 in a further version, which is used particularly with thin roof or wall elements 15, 16. This stop profile 27 is likewise continuous in embodiment and has a trapezoidal cross section, with detent strips 33 formed onto the open side of the cross section; with these strips, the stop profile 27 engages the groove 5 of the profile tube 19. The stop profile 27 also has a formed-in fastening groove 34 for a seal with which the stop profile 27 rests on a wall or roof element 15, 16. This groove 34 is located diagonally opposite the detent strip 33.

Joining of two basic profiles 1 that abut at a right or obtuse angle, for example a pillar and a lateral roof profile, as shown at intersection point A in FIGS. 2 and 8, is preferably done with a mitered joint, by means of a tubular pillar 9 and a connecting angle 10.

The tubular pillar 9 has a rectangular cross section and fits virtually form-fittingly into the receiving chamber 2 of the upright basic profile 1, protruding upward past the miter cut of the basic profile 1, and is equipped with a miter cut 9*a* that corresponds to the oblique position of the lateral roof profile 1.

This part of the tubular pillar 9 protruding outward fits into the chamber 2 of the lateral roof profile 1, so that a positional fixation is attained.

The connecting angle 10 has two rib panels 36 pivotably connected to one another by a pivot shaft 35; they form the legs of the angle and are each inserted at least nearly form-fittingly into a receiving chamber 3 of the two basic profiles 1 to be joined.

Screws 37 fitting laterally into the profile tube 19 in the vicinity of the grooves 5 engage the rib panels 36, thereby fixing the basic profile connection.

Securing of the horizontally extending basic profile 1, for instance serving as a crossbeam, is effected at the intersection point A of FIG. 2 and 8, by means of a crossbeam connector 12. This crossbeam connector 12 of FIG. 13 is composed of an insert 38 and a holder 39; the insert 38 is inserted into the face end of the crossbeam 1, which is lying flat, specifically being inserted into the receiving chamber 2.

The insert chamber 38 is formed of a U-shaped profile 38*a* lying flat and guide panels 38*b* secured to it, so that these guide panels 38*b* provide an at least virtually form-fitting engagement with the inside of the receiving chamber 2.

The crossbar of the U of the insert 48 forms a connecting panel 38*c* that is offset by grooves 38*d* from the legs 38*a* of the U and from the guide panels 38*b*.

The holder 39 is formed by a profile of C-shaped cross section that is slipped onto and fits over the offset connecting panel 38*c*; on its outside, the profile has a formed-on suspension strip 39*a* of hooklike cross section.

In the vicinity of the chamber 2, the basic profile 1 is equipped on one long side with an oblong slot 40, and the tubular pillar 9 upright in the chamber 2 also has an oblong slot 40 coinciding with it. In these two coinciding oblong slots 40, the holder 39 is suspended by its suspension strip 39*a*, to join the two basic profiles 1 abutting at right angles (that is, the pillar and the cross beam).

Fastening of the purlin 1 to the crossbeam 1 is shown at the intersection point B of FIGS. 2 and 9; the purlin, formed by the basic profile 1, is upright, resting on its rectangular cross section. At the intersection point B, the purlin 1 is cut off at the end in a miter cut, and at this mitered joint a short segment 1*a* of a basic profile is fastened in the mitered joint by means of the connecting angle 10, so that this basic profile segment la is perpendicular to the crossbeam 1, which lies flat. A purlin shoe 13 is secured by screws to the crossbeam 1; the shoe is embodied by a U-shaped profile having oblique mitering cuts 13*b* provided on the legs of the U 13*a* in accordance with the mitered joint between the purlin 1 and the basic profile segment 1*a*, and with these legs 13*a* of the U at least virtually form-fittingly engages the receiving chambers 2 of the two abutting profiles 1, 1*a*. In FIG. 11, holes 41 are shown in the purlin shoe 13 for the passage of the fastening screws of the shoe 13 on the crossbeam 1.

The connection between the crossbeam 1 and purlin 1 is also effected by the T connector 14, which is formed by an angle, one leg 14*a* of which, as shown in FIG. 14, has opposing insertion grooves 42, with which the leg 14*a* is made into a T-shaped insertion profile 43 and with this insertion profile 43 engages a groove 5 of the basic profile 1.

The second leg 14*b* of the T connector 14 fits at least virtually form-fittingly into the receiving chamber 3 of the basic profile segment la from below.

A T connector 14 of this kind is also used in the connection shown at point A between the crossbeam 1 and pillar 1 and is secured in the same way. By means of this T connector 14, in addition to the connection with the crossbeam connector 12 or purlin shoe 13, an accurate alignment of the outsides of the basic profiles 1, which are at an angle from one another, is attained.

Joining of the other long ends of a purlin 1 to a horizontally extending basic profile 1 of upright cross section, as a wall attachment profile, is shown at the intersection point D of FIG. 2. Here, a purlin connector 11 of FIG. 12 is used, which is composed of an insert 38 and a holder 39 and is equivalent in its basic principle and in function to the crossbeam connector 12. The insert 38 of the purlin connector 11 is formed by a U-shaped profile with upright legs 38*a* and a crossbeam of a U offset on them; the crossbeam is formed by grooves 38*d* to make a transversely extending connecting panel 38*c*. This insert 38 is inserted by its upright legs 38*a* into the chamber 2 of the purlin The holder 39 is embodied structurally like the holder 39 of the crossbeam connector 12 and is slipped by its C-shaped cross section onto the connecting panel 38*c* and suspended by its hooked suspension strip 39*a* in an oblong slot 40 of the wall attachment profile 1.

The holder 39 can be fixed opposite the insert 38 of the two connectors 11, 12 by means of pins, screws or the like, engaging holes 44 of the C-shaped cross section 39 and of the connecting panel 38*c*, so that transverse shifting of the two parts 38, 39 relative to one another is prevented.

The purlin connection of point E in FIG. 2 is equivalent to the purlin connection of point D, and the crossbeam fastening of point C in FIG. 2 is identical to the crossbeam fastening of intersection A.

In FIG. 15, the roof region of the framework is shown, specifically the attachment to the wall; the wall attachment profile 1 is fixed to the wall face 47 in the equivalent oblique position of the roof elements 15 by means of screws 46, with an interposed wedge 45.

The purlins 1 are then secured to the wall attachment profile 1 by the purlin connectors 11.

The wall attachment profile 1 is covered by a wall sealing profile 48, which extends obliquely to match the slop of the roof, is embodied as a continuous profile, has fastening grooves 49 formed onto one long end for a seal and for fastening with screws or nails to the wall face 47, and on the other end has a window drip 50 bent downward at an angle, and a formed-on supporting and sealing profile 51 extending at a distance from it.

The other long end of the purlin 1 is fixed to the crossbeam 1, which lies flat, as shown at intersection points B; a lining element 52, which is fixed to the crossbeam 1 by the stop profiles 27, is disposed between the crossbeam 1 and purlin 1, or between the crossbeam 1 and the lateral roof profile 1.

A gutter 54 of U-shaped cross section, which has a cross section lending it a large volume and thus a large capacity for rainwater, snow, or the like, can be secured to the smaller profile tube 19 on the outside of the crossbeam by means of a holder 53 that can be screwed to the profile 1.

FIG. 17 shows the disposition of two spaced apart side-by-side basic profiles 1 extending vertically or horizontally, and a ceiling or wall element 15, 16 retained between them by means of the support profiles 6 and stop profiles 27; the outer basic profile 1 is lined with the covering profile 8, with the interposition of the insulating angle 22, to form the peripheral seal.

FIG. 18 is a plan view, again on two basic profiles 1 extending side by side in spaced-apart fashion, with a wall element 16 disposed between them and a wall element 16 adjoining the outer basic profile 1, so that here a corner of the framework is shown. A column-like water compartment 56 that extends downward, surrounding the downspout 55 coming from the gutter 54, is attached to the long side of the profile tube 19 on the corner basic profile 1. The water compartment is composed of a U-like support profile 57 adjoining the profile tube 19 and having connecting legs 58 bent outward at an angle, and a jacket profile 59, likewise of U-shaped cross section; both profiles 57, 59 have detent strips 60 engaging one another from behind and formed onto their connecting legs 58 or U-legs 59*a*, respectively, for the detachable connection of the two profiles 57, 59; see FIG. 19.

The seals between the various profiles are represented by reference numeral 60.

All the profiles 1, 6, 7, 8, 27, 48 and the connectors 9, 10, 11, 12, 13, 14 are formed of aluminum profiles or aluminum elements.

I claim:

1. A construction set for a construction project, said set comprising;

a basic profile (1) having two intrinsically separate and connected profile tubes (18, 19)., said separate profile tubes having hollow interiors and a plurality of fastening grooves, connecting profiles which can be releasably inserted in and attached to the outsides of said basic profile, said connecting profiles comprising;

a covering profile (8) having a continuous U-shaped cross section, said covering profile having an abutment angle (21) formed on a first leg (8*a*) at a first end of said U-shaped cross section, said abutment angle (21) fitting over a corner region of a larger of said two profile tubes, formed as a first profile tube (18), an insulating angle (22) interpositionable between said corner region and said abutment angle (21), detent strips (24) formed on both a second leg (8*b*) at a second end of said U-shaped cross section and a rib (23) spaced from said second leg (8*b*), said detent strips (24) latchable in a first groove (5) of said plurality of fastening grooves, said first groove (5) located on a smaller of said two profile tubes, formed as a second profile tube (19), a first continuous support profile (6) having a U-shaped cross section including a crossbar (6*a*) for resting on the outside of said first profile tube (18), said first support profile (6) engageable to a second groove (4) of said plurality of fastening grooves with a suspension strip (28) formed on said crossbar (6a), said suspension strip (28) having an angular cross section protruding past a first leg (6b) of said first support profile (6), a second leg (6c) of said first support profile (6) forming respectively with said first leg (6b) support and abutment faces for a roof and wall element (15, 16), a second continuous support profile (7) having an angular cross section, said second continuous support profile (7) having a suspension strip (30) insertable into said first groove (5) of said second profile tube (19) and a stop strip (31) opposite said first support profile (6), a continuous stop profile (27) having a trapezoidal cross section, with an open side of said cross section having detent strips (33) insertable in said first groove (5) of said second profile tube (19), and wherein, said covering profile (8), said first continuous support profile (6), said second continuous support (7) and said continuous stop profile (27) are selectively engageable to said fastening grooves of said base profile to form a variety of different building forms.

2. The construction set as defined by claim 1, wherein said profile (8) having a sealing angle (25) on the outside of said first leg with a fastening groove (26), said second support profile (7) having a receiving groove (32) on said stop strip (31), and said stop profile (27) having a formed-in fastening groove (34) for seals for sealed abutment on a roof or wall element diametrically opposite said open side.

3. The construction set as defined by claim 1, wherein said first and second profile tube (18, 19) of the basic profile (1) each have rectangular cross sections; said second profile tube (19) rests with its cross sectional length transversely to the cross sectional length of said first profile tube (18); and two insulating ribs (17) non-detachably engage grooves (20) of undercut cross section formed onto one long side of said second profile tube (19) and one face end of said first profile tube (18).

4. The construction set as defined by claims 1, wherein said plurality of fastening grooves have a T-shaped cross section, said fastening grooves being located on both basic profile long sides, on both sides of said insulating ribs (17), and on said first and second profile tubes (18, 19) said fastening grooves (4, 5) being flush with the long sides of the basic profile, and said two insulating ribs (17) are recessed relative to said grooves (4, 5).

5. The construction set as defined by claim 1 comprising, a connecting angle (10) for basic profiles (1), abutting at a mitering angle, as a vertical pillar and lateral roof profile, which comprises two rib panels (36) pivotably joined together about a pivot shaft (35), which panels each insertable at least virtually form-fittingly into said hollow interior of said second profile tube (19) of two basic profiles (1) to be joined, wherein the two rib panels (36) are lockable to the basic profile walls by means of screws (37) or the like.

6. The construction set as defined by claim 1 comprising, a purlin shoe (13) that can be affixed as a crossbeam by means of screws or the like to a horizontally extending and flat lying basic profile (1), the shoe being U-shaped and fitting with the legs (13a) of the U into a basic profile segment (1a), said basic profile segment secured in mitered abutment to the upright purlin (1) by means of the connecting angle (10), into said hollow interior of said second profile tube, forming a plug-in connection.

7. The construction set as defined by claim 1 comprising, a T connector (14) for fastening a crossbeam to a pillar and fastening said purlin to said crossbeam, the T connector being formed by an angle, one leg (14a) of which is embodied as a T-shaped insertion profile (43) engaging said first fastening groove (5) of said basic profile (1), and the second leg (14b) of which is insertable at least virtually form-fittingly from below into the said hollow interior of said second profile tube of the basic profile segment (1a).

8. The construction set as defined by claim 1 comprising a column-like water compartment (56) surrounding a descending downspout (55) at a distance, which compartment comprises a U-like abutment profile (57) that can be attached to a face end of the basic profile (91), preferably to the tube profile (19), the abutment profile having connecting legs (58) bent outward at an angle, and a U-shaped jacket profile (59), wherein both profiles (57, 59) have formed-on detent strips (60), engaging one another from behind, on their connecting legs (58) and the legs (59a) of the U for detachable connection of the water compartment profiles (57, 59).

9. The construction set as defined by claim 1, wherein said profiles (1, 6, 7, 8, 27, 48) and said connectors (9, 10, 11, 12, 13, 14) are formed by aluminum profiles or aluminum parts.

10. The construction set as defined by claim 1, characterized by a purlin or crossbeam connector (11, 12) formed by an insert (38) and a holder (39), wherein the insert (38) is formed by a U-shaped or box profile (38a, 38b), at least virtually form-fittingly fitting into said hollow interior (2) of said first profile tube (18) and having an offset connecting panel (38c), said holder (39) being formed by a profile of C-shaped cross section slipping onto and overlapping the offset connecting panel (38c), said holder (39) equipped with a suspension strip (39a) of hooked cross section, with which it fits into an oblong slot (40) of said first profile tube (18) and an oblong slot (40), disposed coincidentally therewith, of a tubular pillar (9) inserted at least virtually form-fittingly into said hollow interior (2) of said first profile tube (18), and engages the oblong slot (40) of the tubular pillar (9) from behind.

11. The construction set as defined by claim 10, wherein said purlins (1) are each fixed with one said purlin connector (11) to said basic profile (1) in the form of a wall attachment profile standing on edge, and this wall attachment profile (1) can be covered by a continuous wall covering profile (48).

* * * * *